US007758908B2

(12) United States Patent
Pham et al.

(10) Patent No.: US 7,758,908 B2
(45) Date of Patent: Jul. 20, 2010

(54) METHOD FOR SPRAY COATING A MEDICAL DEVICE USING A MICRONOZZLE

(75) Inventors: Lan Pham, Nashua, NH (US); Gerald Fredrickson, Westford, MA (US)

(73) Assignee: Boston Scientific Scimed, Inc., Maple Grove, MN (US)

( * ) Notice: Subject to any disclaimer, the term of this patent is extended or adjusted under 35 U.S.C. 154(b) by 1042 days.

(21) Appl. No.: 11/390,179

(22) Filed: Mar. 28, 2006

(65) Prior Publication Data

US 2007/0231457 A1 Oct. 4, 2007

(51) Int. Cl.
*B05D 1/02* (2006.01)
*B05B 7/10* (2006.01)

(52) U.S. Cl. ..... 427/2.1; 427/2.24; 427/2.25; 427/421.1; 118/300; 239/424

(58) Field of Classification Search ..... 427/2.1–2.31; 239/424, 424.5

See application file for complete search history.

(56) References Cited

U.S. PATENT DOCUMENTS 5,435,884 A * 7/1995 Simmons et al. ..... 216/100
5,594,987 A * 1/1997 Century ..... 29/890.143
6,189,214 B1 * 2/2001 Skeath et al. ..... 29/890.142
6,547,163 B1 4/2003 Mansour et al.
6,919,046 B2 7/2005 O'Connor et al.
2003/0143315 A1 * 7/2003 Pui et al. ..... 427/2.1
2004/0013792 A1 1/2004 Epstein et al.
2005/0175772 A1 * 8/2005 Worsham et al. ..... 427/165
2005/0202156 A1 9/2005 O'Connor et al.

OTHER PUBLICATIONS

Worden et al., "Impact of pressure-swirl, nebulization, and electrostatic atomizers on macromolecules" in *ILASS Americas, 16th Annual Conference on Liquid Atomization and Spray Systems*, (May 2003).

* cited by examiner

*Primary Examiner*—Timothy H Meeks
*Assistant Examiner*—Cachet I Sellman
(74) *Attorney, Agent, or Firm*—Kenyon & Kenyon LLP

(57) ABSTRACT

The present invention provides for a method for spray application of a coating material onto a medical device by spraying coating material from a micronozzle fabricated from a plurality of sheets that are etched with holes or openings. The openings are aligned to form fluid channels and the sheets are fused together in a planar fashion to define a micronozzle. In another embodiment, the invention provides for a method for spray application of a coating material onto a medical device using micronozzles fabricated in batches by a simplified manufacturing process. In other embodiments, the invention provides for a method for spray application of a coating material onto a medical device by spraying coating material from a micronozzle that includes a swirl or gas-assist atomizer.

20 Claims, 7 Drawing Sheets

METHOD FOR SPRAY COATING A MEDICAL DEVICE USING A MICRONOZZLE

TECHNICAL FIELD

The present invention relates to the spray coating of medical devices.

BACKGROUND

Coatings are often applied to implantable medical devices to increase their effectiveness or safety. These coatings may provide a number of benefits including reducing the trauma suffered during the insertion procedure, facilitating the acceptance of the medical device into the target site, or improving the effectiveness of the device.

A coating that serves as a therapeutic agent is one such way in which the coating on a medical device can improve its effectiveness. This type of coating on the medical device allows for localized delivery of therapeutic agents at the site of implantation and avoids the problems of systemic drug administration, such as producing unwanted effects on parts of the body which are not being treated, or not being able to deliver a high enough concentration of therapeutic agent to the afflicted part of the body.

Expandable stents are one specific example of medical devices that can be coated. Expandable stents are tubular structures formed in a mesh-like pattern designed to support the inner walls of a lumen, such as a blood vessel. These stents are typically positioned within a lumen and then expanded to provide internal support for the lumen. Because the stent comes into direct contact with the inner walls of the lumen, stents have been coated with various compounds and therapeutics to enhance their effectiveness. The coating on these stents may contain a drug or biologically active material which is released in a controlled fashion (including long-term or sustained release) and delivered locally to the surrounding blood vessel.

Aside from facilitating localized drug delivery, the coating on a medical device can provide other beneficial surface properties. For example, medical devices are often coated with radiopaque materials to allow for fluoroscopic visualization during placement in the body. It is also useful to coat certain devices to enhance biocompatibility or to improve surface properties such as lubricity.

One way in which a coating can be applied to a medical device is to spray the coating substance onto the device using a spray nozzle that atomizes the coating substance. Conventional spray nozzles used in coating medical devices create a wide spray plume. A wide spray plume can result in low transfer efficiencies because only a small amount of the sprayed coating material may be deposited on the medical device. For a small-sized medical device, such as a coronary stent, the transfer efficiency can be very low. Much of the coating solution is lost in excessive overspraying and is therefore wasted. Transfer efficiencies are important as some coating materials are expensive, such as therapeutic agents, drugs and polymers. In addition, the quality of the spray plume from conventional spray nozzles can be inconsistent, causing variability in the thickness of the coating. Thus, the coating may be thicker at one end of the device, or the coating thickness may vary on an individual target-to-target basis, reducing manufacturing reproducibility. Such variability could be detrimental to obtaining uniform coating distribution and thickness on the target, making it difficult to predict the dosage of therapeutic that will be delivered when the medical device or stent is implanted.

Therefore, there is a need for a cost-effective method for improving the performance of spray coating medical devices by reducing the size of the spray plume, which would improve coating transfer efficiency, increase coating uniformity and permit precise control of coating deposition.

SUMMARY OF THE INVENTION

The present invention is directed to a method for spray coating a medical device that answers this need. In certain embodiments of the invention, a method is provided for applying a coating material onto a medical device with a micronozzle that creates a smaller spray plume and finer spray droplets, resulting in improved coating transfer efficiency, increased coating uniformity, and precise control of coating deposition.

In another embodiment of the invention, a method is provided for applying a coating material onto a medical device with a micronozzle wherein the micronozzle is formed from a plurality of sheets with openings that define fluid passageways when the sheets are aligned and fused together.

In another embodiment of the invention, a method is provided for applying a coating material onto a medical device with a micronozzle wherein the micronozzle is used for applying a coating material containing a therapeutic agent.

In another embodiment of the invention, a method is provided for applying a coating material onto a medical device with a micronozzle wherein the spray plume is small enough that the user can selectively apply coating to portions of a small medical device.

In another embodiment of the invention, a method is provided for applying a coating material onto a medical device with a micronozzle wherein streams of gas are used to assist in atomizing the fluid. Jets of atomizing gas are introduced near the exit orifice of the micronozzle such that the coating fluid ejected from the exit orifice is entrained within the gas flow, causing the coating fluid to become atomized.

DETAILED DESCRIPTION

Figure 1:
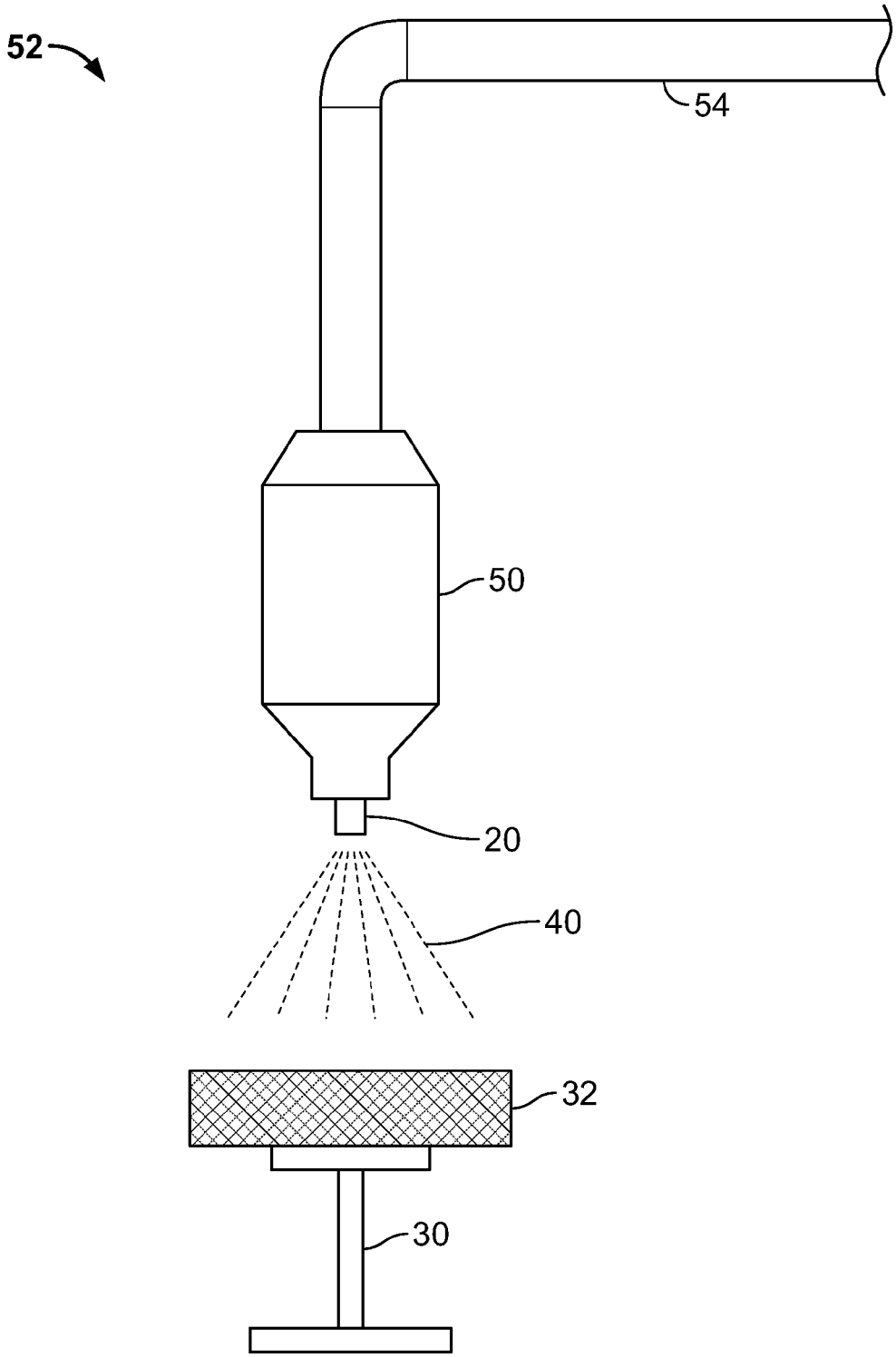
FIG. 1 is a schematic view of a first embodiment of a method of spray application of a coating fluid onto a medical device in accordance with the present invention.

A first embodiment of the present invention is illustrated in FIG. 1. In this embodiment, a medical device 32 to be coated with a coating material is held by a target holder 30. The medical device 32 depicted in FIG. 1 is a coronary stent that is to be coated with a therapeutic material. However, a person of ordinary skill in the art would understand that a variety of medical devices may be coated with the embodiments depicted in the present invention. Non-limiting examples of other medical devices include catheters, guide wires, balloons, filters (e.g., vena cava filters), stents, stent grafts, vascular grafts, intraluminal paving systems, pacemakers, electrodes, leads, defibrillators, joint and bone implants, vascular access ports, intra-aortic balloon pumps, heart valves, sutures, artificial hearts, neurological stimulators, cochlear implants, retinal implants, and other devices that can be used in connection with therapeutic coatings. Such medical devices are implanted or otherwise used in body structures such as the coronary vasculature, esophagus, trachea, colon, biliary tract, urinary tract, prostate, brain, lung, liver, heart, skeletal muscle, kidney, bladder, intestines, stomach, pancreas, ovary, uterus, cartilage, eye, bone, and the like.

As shown in FIG. 1, the spray nozzle 52, which is in an upstream relation to the medical device 32, includes a micronozzle 20 and nozzle body 50. The coating material supply line 54, nozzle body 50 and micronozzle 20 all are in fluid communication with each other. The target holder 30 may hold the medical device 32 by any number of means, such as the stent holders described in U.S. patent application Ser. No. 10/198,094, whose entire disclosure is incorporated by reference herein.

Figure 2:
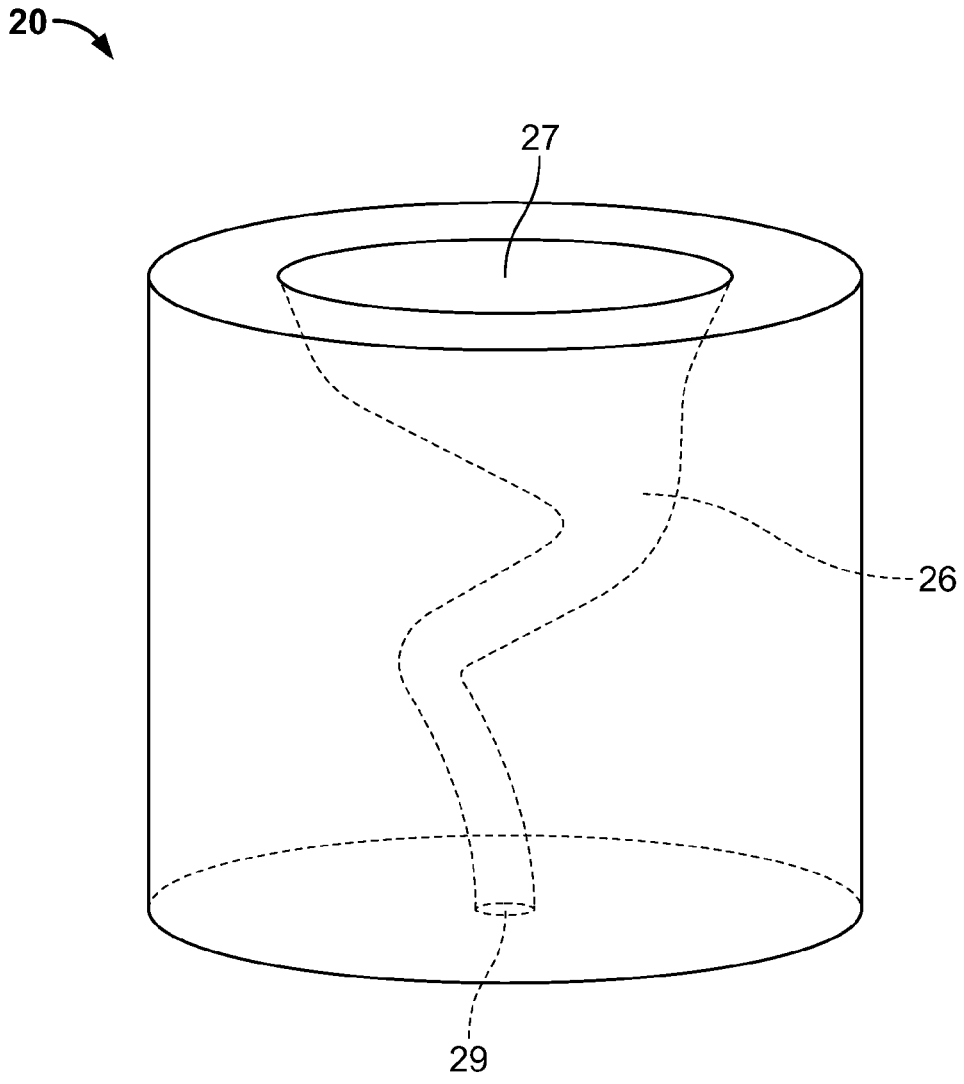
FIG. 2 is a perspective view of an embodiment of a micronozzle having an inlet and exit orifice.

Referring to FIGS. 1 and 2, the micronozzle 20 is adapted to receive coating material from supply line 54 and atomize the coating material, thereby creating coating material droplets 40 which are propelled towards the target medical device 32. Referring to FIG. 2, the coating material enters the micronozzle 20 through an inlet 27, travels through a microsized fluid passageway 26, and becomes atomized as it exits through a nozzle orifice 29. The microsized fluid passageway 26 defines a complex fluid path to control the coating material flow rate and pressure drop through the micronozzle 20.

As used herein, the term "micronozzle" contemplates a spray nozzle having channels, passageways, or orifices having a minimum cross-section diameter that is less than 1000 μm and preferably in the range of 125 μm to 500 μm. This does not exclude large chambers, cavities or internal structures within the nozzle or which are directly connected to the inlet ports of the nozzle. Further, the term "micronozzle" is used only to characterize nozzles with respect to the size of the channels, passageways, or orifices in the nozzle, and does not exclude nozzles in which the overall nozzle body is of conventional size.

One of ordinary skill in the art would understand that the diameters and dimensions of the microsized passageways and exit orifices can vary depending on the properties of the fluid or material to be atomized, the required atomization pressures, and the flow rates. For example, exit orifices of less than about 0.1 inches in diameter and as small as 0.002 inches in diameter have been disclosed in U.S. Pat. No. 5,435,884 to Simmons et al. (filed Sep. 30, 1993), which regards the manufacture and use of atomizing spray nozzles in automotive and aerospace fuel applications. The entire disclosure of this patent is incorporated by reference herein.

Figure 3:
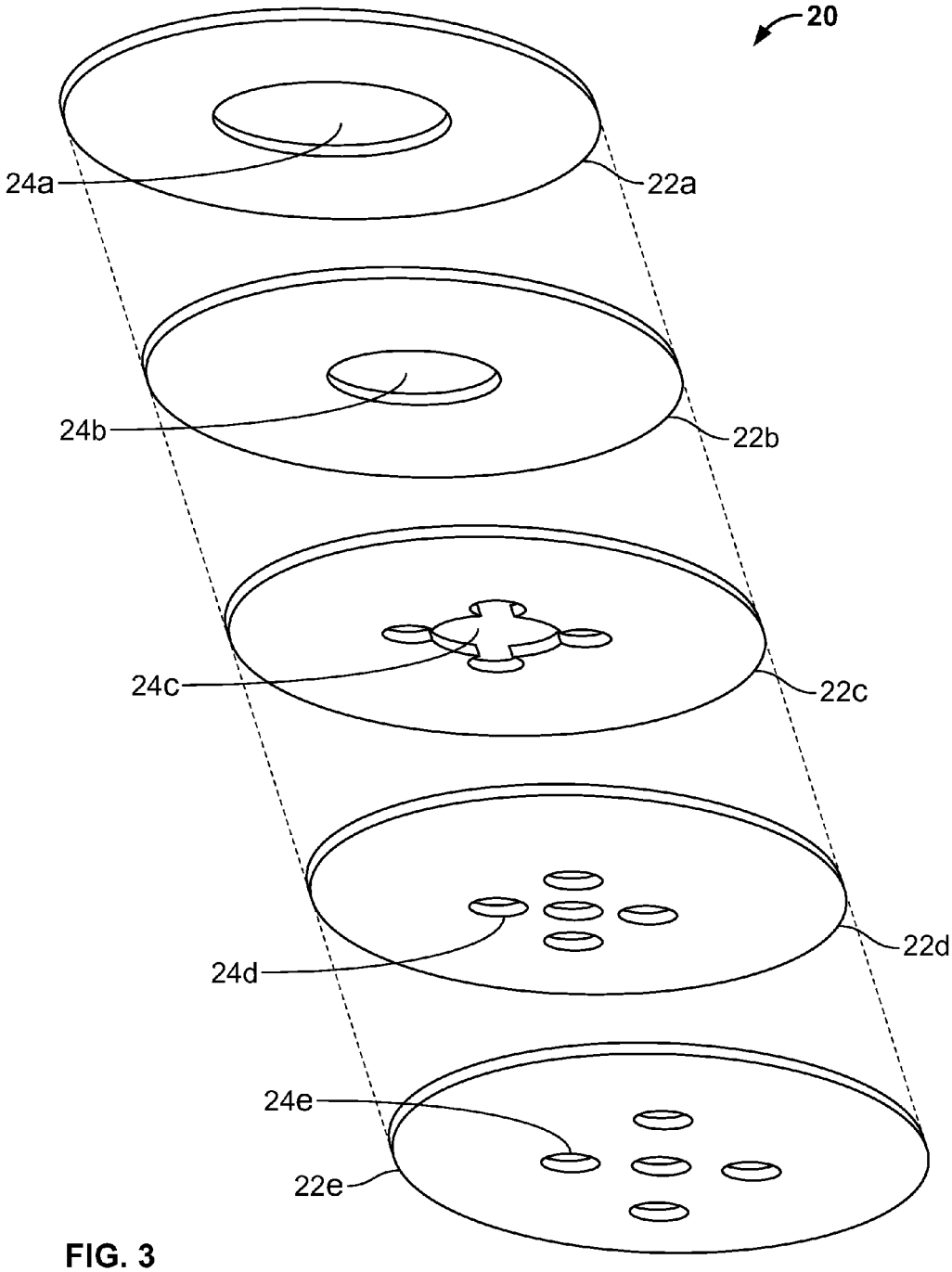
FIG. 3 is an exploded view of an embodiment of a micronozzle formed from a plurality of sheets.

The microsized fluid passageways within the micronozzle can be formed by a variety of microfabrication techniques. For example, FIG. 3 illustrates another embodiment in which the micronozzle is constructed from layers of sheets 22*a*-22*e* on which one or more variously shaped and oriented openings 24*a*-24*e* have been formed, either partially or completely through the thickness of the sheets 22*a*-22*e*, and in which the openings 24*a*-24*e* permit fluid movement either within the sheets or through the sheets. In alternate embodiments, portions of the micronozzle are constructed from layers of sheets whereas other portions are constructed by other microfabrication techniques (as listed below).

A person of ordinary skill in the art would understand that the openings in the sheets could be formed by a variety of methods that can cut, etch or otherwise remove portions of the sheets to form the openings. For example, the variously shaped and oriented openings 24*a*-24*e* can be cut or removed from the sheets 22*a*-22*e* by an etching process. Etching by chemical or electrochemical processes is well known in the art. For example, U.S. Pat. No. 5,435,884 to Simmons et al. (filed on Sep. 30, 1993) discloses a method of using etching techniques to form an atomizing spray nozzle for automotive and aerospace engine applications; and U.S. Pat. No. 6,189,214 to Skeath et al. (filed on Jul. 8, 1997) discloses a method of etching patterns on silicon layers to form an atomizing nozzle for use in inhalers and combustion engines. The disclosures of both patents are incorporated by reference herein. One of ordinary skill in the art would understand that the openings can also be formed by laser drilling techniques well known in the silicon wafer manufacturing industry.

One of ordinary skill in the art would understand that the sheets used in making the micronozzles can be made of any material, including certain etchable materials such as metals (e.g., stainless steel and aluminum), ceramics, polymers, composites, and other non-metallics (e.g., silicon, silicon carbide, alumina, and silicon nitride). The sheets should be of sufficient thickness to maintain the structural integrity of the openings in the sheet during the bonding process.

Referring back to FIG. 3, a plurality of sheets 22*a*-22*e* are bonded or fused together in a planar fashion, to form a laminated micronozzle. One of ordinary skill in the art would understand that the plurality of sheets can be bonded or fused together by a number of methods well known in the field such as heat fusion or welding. The sheets 22*a*-22*e* are aligned such that the openings 24*a*-24*e* on the sheets define one or more fluid passageways that extend from the nozzle inlet to the nozzle exit orifices. The passageways created can include channels, chambers, or other types of cavities within the nozzle. The term "passageway" as used herein is not intended to be restricted to elongated configurations where the transverse or longitudinal dimension-greatly exceeds the diameter or cross-section dimension. Rather, the term is meant to comprise cavities or tunnels of any desired shape or configuration through which fluids may be directed. Furthermore, the term "openings" or "holes" as used herein is not intended to be restricted to openings or foramens through the sheets. Rather, the term is meant to also include cutouts, depressions, or grooves.

One of ordinary skill in the art will appreciate that other microfabrication techniques can be employed in fabricating the micronozzle 20, including lithography, pattern transfer, wet and dry bulk micromachining, surface micromachining, LIGA, wafer bonding, and micromolding. One of ordinary skill in the art will also appreciate that a variety of designs and dimensions exist for the fluid passageways 26 in the micronozzle 20. For example, in the embodiment illustrated in FIG. 3, the micronozzle includes a plurality of fluid passageways defined by a plurality of openings 24*a*-24*e*.

In operation, referring to FIGS. 1 and 2, the target medical device 32 to be coated is placed on holder 30 and positioned in a downstream relation to the spray nozzle 52 (i.e., downstream of the direction of spray). Coating material is supplied to the nozzle body 50 from a coating material reservoir (not shown) via a coating material supply line 54. The coating material is injected into the nozzle body 50 and through the micronozzle 20, where it is atomized. The atomized coating material is ejected from the orifice 29 as coating material particles 40 which are propelled towards the medical device 32. The smaller exit orifice 29 allows for a smaller and more controllable spray plume than conventional spray processes.

Figure 4:
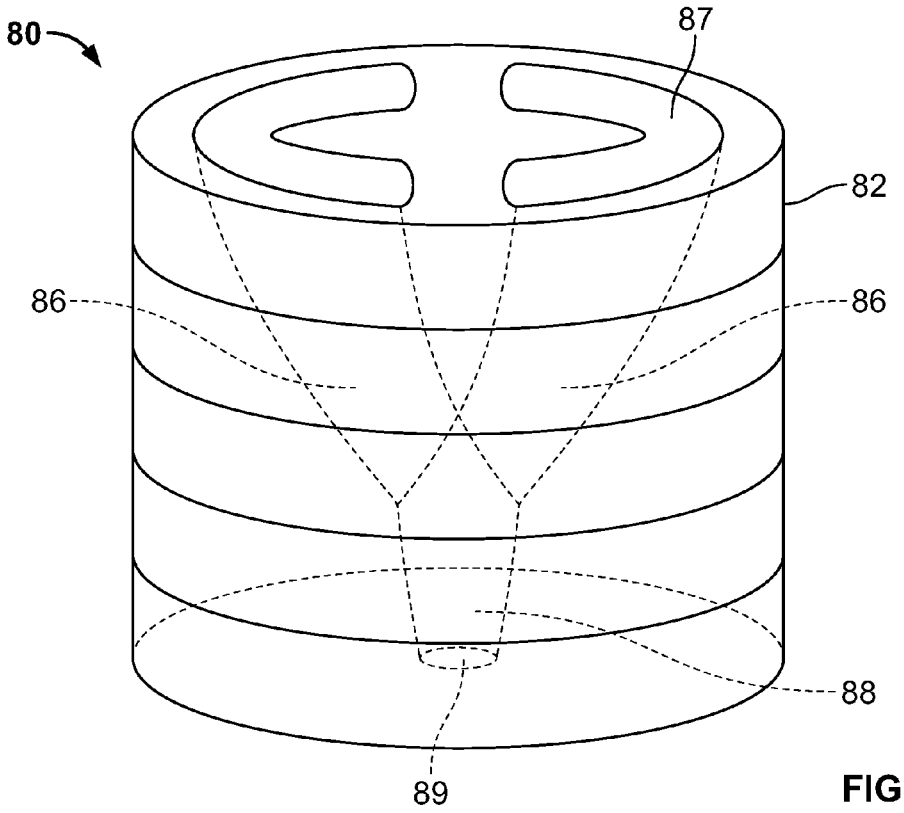
FIG. 4 is a perspective view of another embodiment of a micronozzle formed from a plurality of sheets.
Figure 5:
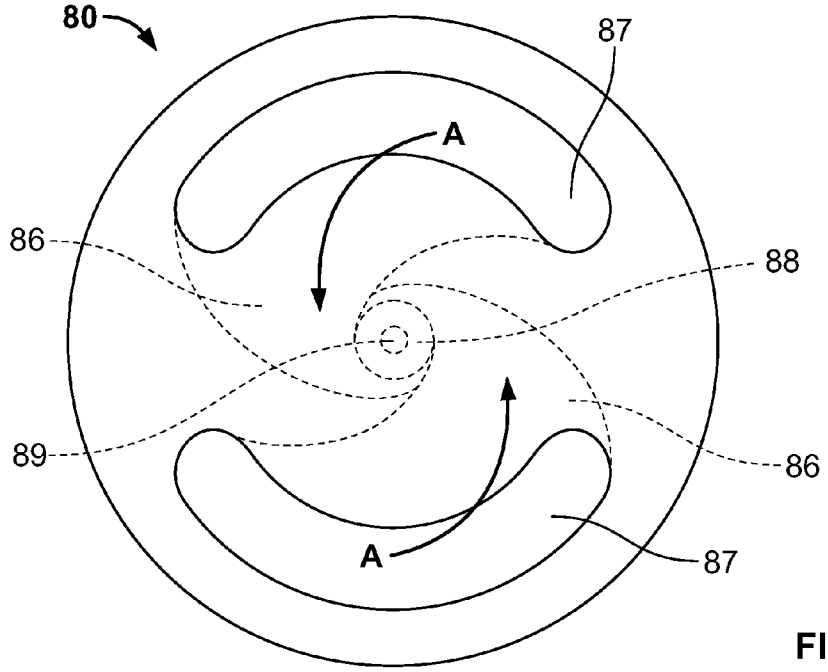
FIG. 5 is a top view of the micronozzle illustrated in FIG. 4.

In another embodiment, as illustrated in FIGS. 4 and 5, the coating material enters the micronozzle 80 through inlets 87 and then flow through the fluid passageways 86, which are angled (tangentially) with respect to the central axis of the spray nozzle to cause the fluid to swirl circumferentially and downward (in the direction of arrow A) when dispensed through the micronozzle 80 from inlet 87 towards exit orifice 89. The passageways 86 converge at a swirl chamber 88 where the fluid continues to rotate circumferentially in a swirling motion. The fluid then exits through an exit orifice 89. One of ordinary skill in the art will understand that there are various designs of swirl nozzles well known in the art. For example, a swirl nozzle is described in U.S. Pat. No. 5,435,884 as noted previously. One of skill in the art will also understand that although two fluid passageways 86 are illustrated in FIGS. 4 and 5, more than two such passageways can be used to cause the fluid to swirl circumferentially downward.

In certain embodiments of this invention, the spray plume produced by the micronozzle is small enough that the user can selectively apply coating material to portions of a small medical device, such as a stent. For example, the user may wish to coat one end only of a stent, or other distinct portions of a stent or medical device. In other embodiments, a plurality of micronozzles may be used together to simultaneously coat different portions of a medical device, or the entire medical device. For example, a plurality of micronozzles may be arranged in a linear direction to provide coating coverage along the entire length of a medical device, such as along the longitudinal direction of a stent. Alternatively, an array of micronozzles can be arranged to provide coating coverage for a distinct area of a medical device. Thus, one of ordinary skill in the art can appreciate that a variety of micronozzle arrangements can be designed to coat the entire medical device without traversing the medical device. One of ordinary skill in the art would also understand that the spray plume of the micronozzle can be appropriately sized to a desired plume coverage.

Figure 6:
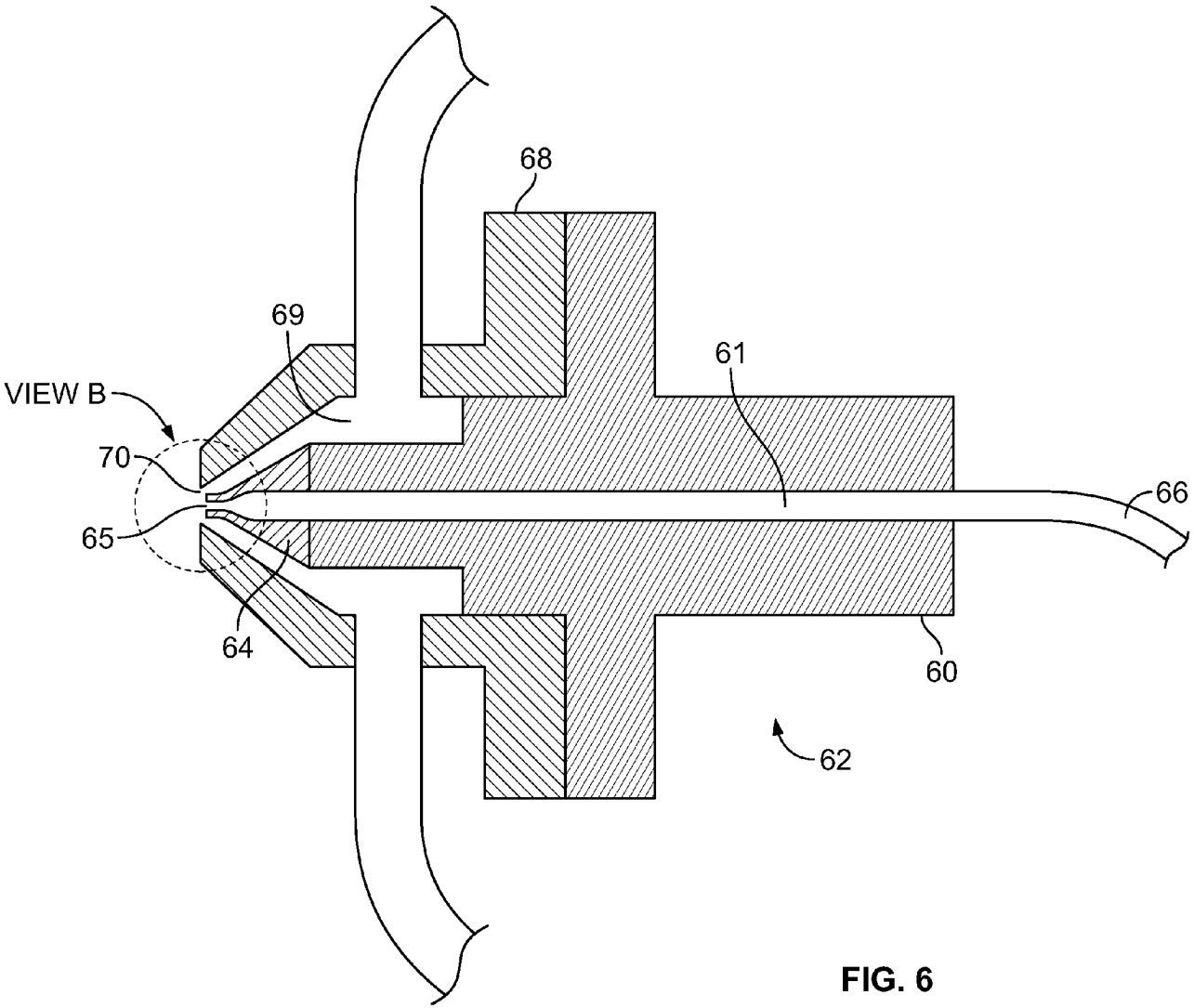
FIG. 6 is a cross-sectional view of an embodiment of a gas-assist atomizer having a micronozzle tip.
Figure 7A:
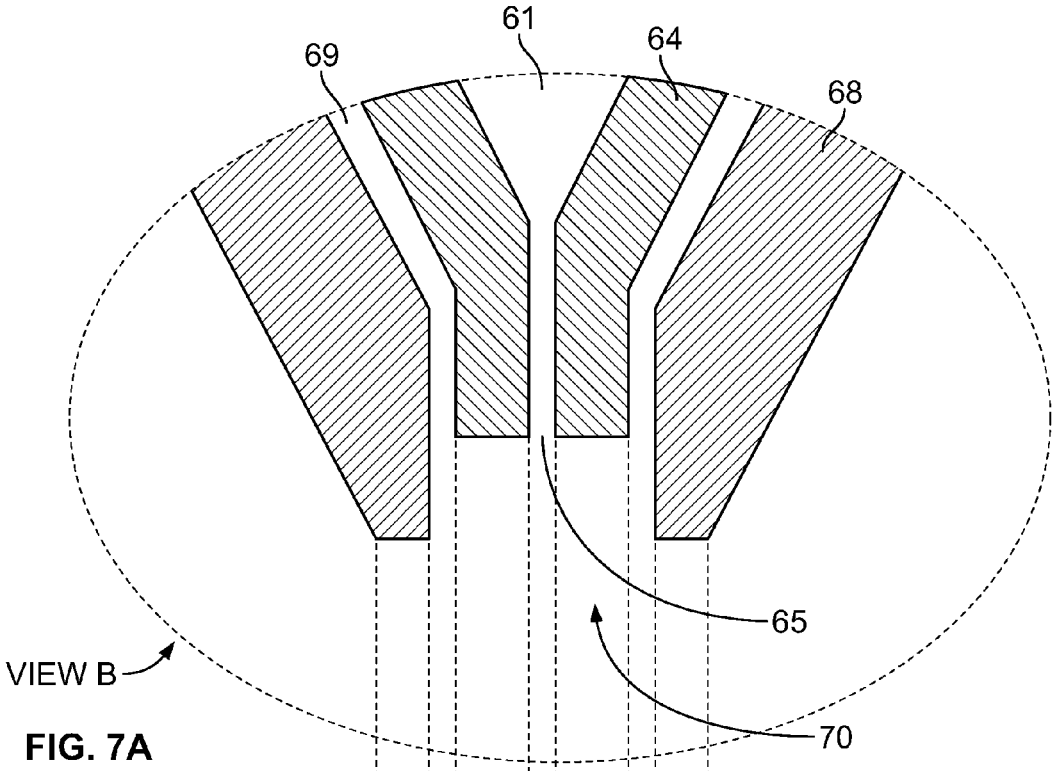
FIG. 7A is an enlarged cross-sectional view of a gas-assist atomizer having a micronozzle tip taken at View B of FIG. 6.
Figure 7B:
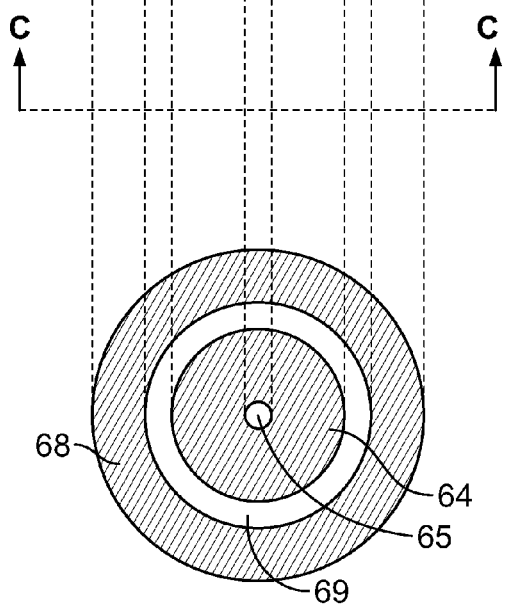
FIG. 7B is an enlarged end view of an embodiment of a gas-assist atomizer having a micronozzle tip taken along line C-C of FIG. 7A.

In another alternate embodiment, as illustrated in FIGS. 6, 7A and 7B, streams of gas are used to assist the micronozzle in atomizing the coating material. One of ordinary skill in the art will appreciate that a variety of gas-assist atomizing devices may be used in the present invention. For example, the gas-assist atomizing device 62 may comprise of multiple parts. The gas-assist atomizing device may include a coating fluid nozzle body 60; a micronozzle tip 64; a coating fluid passageway 61 in fluid communication with the coating fluid supply line 66, nozzle body 60, and micronozzle tip 64; and an atomizing ring 68. The assembly of the nozzle body 60, micronozzle tip 64, and atomizing ring 68 creates an atomizing gas passageway 69 positioned concentric to the coating fluid passageway 61. The atomizing gas flows through the atomizing gas passageway 69 and is ejected from atomizing nozzle orifice 70. In operation, the coating material is atomized when it is ejected from the micronozzle orifice 65 into a low-pressure region created by the flow of gas around the atomizing nozzle orifice 70 and is entrained within the gas flow. One of skill in the art will appreciate that a variety of atomizing gases may be used, including air or nitrogen.

Figure 8:
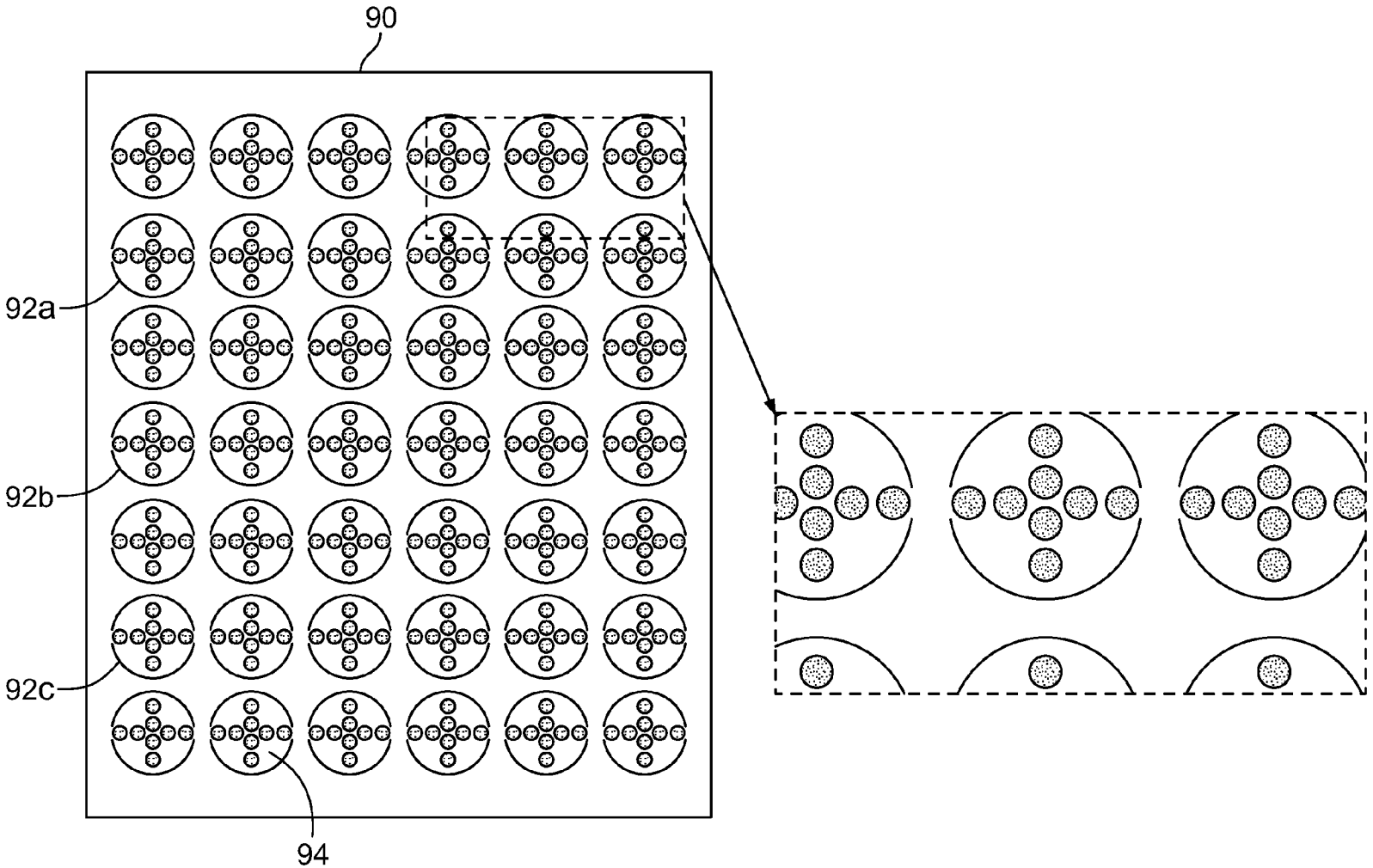
FIG. 8 is a top view of a sheet having a plurality of nozzle sections.

The micronozzles can also be fabricated at low costs. FIG. 8 shows a large number of micronozzle sections 92*a*-92*c* etched simultaneously on a single sheet 90. This allows micronozzles to be produced in batches, similar to the production of batches of integrated circuits. A sheet 90 is processed so as to have a plurality of sections 92*a*-92*c* that each constitute one layer of a micronozzle. Each section 92 has holes or openings 94 formed or cut from it to define part of a fluid passageway. Similarly, another sheet is created having a plurality of sections that each constitute another layer of a micronozzle. Yet more sheets are created having a plurality of sections that each constitute yet another layer of a micronozzle. The sheets are aligned and fused to form a batch of micronozzles, which are then separated from the sheets. Thus, a laminated micronozzle formed from a plurality of segments can be created at low cost. Alternatively, each individual section 92 of the sheet 90 could be separated before fusing them so that the micronozzles are formed individually. One of skill in the art will appreciate that micronozzles used in the present invention can be manufactured at low cost, allowing for cost-efficient replacement of clogged or malfunctioning nozzles, and thus reducing the costs associated with the spray coating of medical devices.

In the spraying of DNA molecules, short residence times in the spray nozzle have been shown to reduce the amount of DNA degradation that typically occurs during the spray process. See Worden et al., "Impact of pressure-swirl, nebulization, and electrostatic atomizers on macromolecules," at the 16$^{th}$ Annual Conference on Liquid Atomization and Spray Systems (May 2003), which is incorporated by reference herein. Because the micronozzle used in the present invention has smaller passageways than a conventional nozzle, the coating material will experience shorter residence times as compared with conventional spray nozzles which typically have residence times greater than 0.01 seconds. For example, a micronozzle used in the present invention can be designed to have a residence time of approximately 0.001 seconds. Such short residence times may reduce the amount of damage to a polymer or therapeutic agent in the coating material.

The therapeutic agent may be any pharmaceutically acceptable agent such as a non-genetic therapeutic agent, a biomolecule, a small molecule, or cells.

Exemplary non-genetic therapeutic agents include antithrombogenic agents such heparin, heparin derivatives, prostaglandin (including micellar prostaglandin E1), urokinase, and PPack (dextrophenylalanine proline arginine chloromethylketone); anti-proliferative agents such as enoxaprin, angiopeptin, sirolimus (rapamycin), tacrolimus, everolimus, zotarolimus, monoclonal antibodies capable of blocking smooth muscle cell proliferation, hirudin, and acetylsalicylic acid; anti-inflammatory agents such as dexamethasone, rosiglitazone, prednisolone, corticosterone, budesonide, estrogen, estradiol, sulfasalazine, acetylsalicylic acid, mycophenolic acid, and mesalamine; anti-neoplastic/anti-proliferative/anti-mitotic agents such as paclitaxel, epothilone, cladribine, 5-fluorouracil, methotrexate, doxorubicin, daunorubicin, cyclosporine, cisplatin, vinblastine, vincristine, epothilones, endostatin, trapidil, halofuginone, and angiostatin; anti-cancer agents such as antisense inhibitors of c-myc oncogene; anti-microbial agents such as triclosan, cephalosporins, aminoglycosides, nitrofurantoin, silver ions compounds, or salts; biofilm synthesis inhibitors such as non-steroidal anti-inflammatory agents and chelating agents such as ethylenediaminetetraacetic acid, O,O'-bis (2-aminoethyl) ethyleneglycol-N,N,N',N'-tetraacetic acid and mixtures thereof; antibiotics such as gentamycin, rifampin, minocyclin, and ciprofolxacin; antibodies including chimeric antibodies and antibody fragments; anesthetic agents such as lidocaine, bupivacaine, and ropivacaine; nitric oxide; nitric oxide (NO) donors such as linsidomine, molsidomine, L-arginine, NO-carbohydrate adducts, polymeric or oligomeric NO adducts; anti-coagulants such as D-Phe-Pro-Arg chloromethyl ketone, an RGD peptide-containing compound, heparin, antithrombin compounds, platelet receptor antagonists, anti-thrombin antibodies, anti-platelet receptor antibodies, enoxaparin, hirudin, warfarin sodium, Dicumarol, aspirin, prostaglandin inhibitors, platelet aggregation inhibitors such as cilostazol and tick antiplatelet factors; vascular cell growth promoters such as growth factors, transcriptional activators, and translational promoters; vascular cell growth inhibitors such as growth factor inhibitors, growth factor receptor antagonists, transcriptional repressors, translational repressors, replication inhibitors, inhibitory antibodies, antibodies directed against growth factors, bifunctional molecules consisting of a growth factor and a cytotoxin, bifunctional molecules consisting of an antibody and a cytotoxin; cholesterol-lowering agents; vasodilating agents; agents which interfere with endogenous vasoactive mechanisms; inhibitors of heat shock proteins such as geldanamycin; angiotensin converting enzyme (ACE) inhibitors; beta-blockers; bAR kinase (bARKct) inhibitors; phospholamban inhibitors; protein-bound particle drugs such as ABRAXANE™; and any combinations and prodrugs of the above.

Exemplary biomolecules include peptides, polypeptides and proteins; oligonucleotides; nucleic acids such as double or single stranded DNA (including naked and cDNA), RNA, antisense nucleic acids such as antisense DNA and RNA, small interfering RNA (siRNA), and ribozymes; genes; carbohydrates; angiogenic factors including growth factors; cell cycle inhibitors; and anti-restenosis agents. Nucleic acids may be incorporated into delivery systems such as, for example, vectors (including viral vectors), plasmids or liposomes.

Non-limiting examples of proteins include serca-2 protein, monocyte chemoattractant proteins ("MCP-1") and bone morphogenic proteins ("BMPs"), such as, for example, BMP-2, BMP-3, BMP-4, BMP-5, BMP-6 (Vgr-1), BMP-7 (OP-1), BMP-8, BMP-9, BMP-10, BMP-11, BMP-12, BMP-13, BMP-14, BMP-15. Preferred BMPs are any of BMP-2, BMP-3, BMP-4, BMP-5, BMP-6, and BMP-7. These BMPs can be provided as homodimers, heterodimers, or combinations thereof, alone or together with other molecules. Alternatively, or in addition, molecules capable of inducing an upstream or downstream effect of a BMP can be provided. Such molecules include any of the "hedgehog" proteins, or the DNAs encoding them. Non-limiting examples of genes include survival genes that protect against cell death, such as anti-apoptotic Bcl-2 family factors and Akt kinase; serca 2 gene; and combinations thereof. Non-limiting examples of angiogenic factors include acidic and basic fibroblast growth factors, vascular endothelial growth factor, epidermal growth factor, transforming growth factor $\alpha$ and $\beta$, platelet-derived endothelial growth factor, platelet-derived growth factor, tumor necrosis factor $\alpha$, hepatocyte growth factor, and insulin like growth factor. A non-limiting example of a cell cycle inhibitor is a cathespin D (CD) inhibitor. Non-limiting examples of anti-restenosis agents include p15, p16, p18, P19, p21, p27, p53, p57, Rb, nFkB and E2F decoys, thymidine kinase ("TK") and combinations thereof and other agents useful for interfering with cell proliferation.

Exemplary small molecules include hormones, nucleotides, amino acids, sugars, and lipids and compounds have a molecular weight of less than 100 kD.

Exemplary cells include stem cells, progenitor cells, endothelial cells, adult cardiomyocytes, and smooth muscle cells. Cells can be of human origin (autologous or allogenic) or from an animal source (xenogenic), or genetically engineered. Non-limiting examples of cells include side population (SP) cells, lineage negative ($Lin^-$) cells including $Lin^-CD34^-$, $Lin^-CD34^+$, $Lin^-cKit^+$, mesenchymal stem cells including mesenchymal stem cells with 5-aza, cord blood cells, cardiac or other tissue derived stem cells, whole bone marrow, bone marrow mononuclear cells, endothelial progenitor cells, skeletal myoblasts or satellite cells, muscle derived cells, go cells, endothelial cells, adult cardiomyocytes, fibroblasts, smooth muscle cells, adult cardiac fibroblasts+5-aza, genetically modified cells, tissue engineered grafts, MyoD scar fibroblasts, pacing cells, embryonic stem cell clones, embryonic stem cells, fetal or neonatal cells, immunologically masked cells, and teratoma derived cells.

Any of the therapeutic agents may be combined to the extent such combination is biologically compatible.

Any of the above mentioned therapeutic agents may be incorporated into a polymeric coating on the medical device or applied onto a polymeric coating on a medical device. The polymers of the polymeric coatings may be biodegradable or non-biodegradable. Non-limiting examples of suitable non-biodegradable polymers include polystyrene; polyisobutylene copolymers, styrene-isobutylene block copolymers such as styrene-isobutylene-styrene tri-block copolymers (SIBS) or other block copolymers such as styrene-ethylene/butylene-styrene (SEBS); polyvinylpyrrolidone including cross-linked polyvinylpyrrolidone; polyvinyl alcohols, copolymers of vinyl monomers such as EVA; polyvinyl ethers; polyvinyl aromatics; polyethylene oxides; polyesters including polyethylene terephthalate; polyamides; polyacrylamides; polyethers including polyether sulfone; polyalkylenes including polypropylene, polyethylene and high molecular weight polyethylene; polyurethanes; polycarbonates, silicones; siloxane polymers; cellulosic polymers such as cellulose acetate; polymer dispersions such as polyurethane dispersions (BAYHYDROL™); squalene emulsions; and mixtures and copolymers of any of the foregoing.

Non-limiting examples of suitable biodegradable polymers include polycarboxylic acid, polyanhydrides including maleic anhydride polymers; polyorthoesters; poly-amino acids; polyethylene oxide; polyphosphazenes; polylactic acid, polyglycolic acid and copolymers and mixtures thereof such as poly(L-lactic acid) (PLLA), poly(D,L,-lactide), poly (lactic acid-co-glycolic acid), 50/50 (DL-lactide-co-glycolide); polydioxanone; polypropylene fumarate; polydepsipeptides; polycaprolactone and co-polymers and mixtures thereof such as poly(D,L-lactide-co-caprolactone) and polycaprolactone co-butylacrylate; polyhydroxybutyrate valerate and blends; polycarbonates such as tyrosine-derived polycarbonates and arylates, polyiminocarbonates, and polydimethyltrimethylcarbonates; cyanoacrylate; calcium phosphates; polyglycosaminoglycans; macromolecules such as polysaccharides (including hyaluronic acid; cellulose, and hydroxypropylmethyl cellulose; gelatin; starches; dextrans; alginates and derivatives thereof), proteins and polypeptides; and mixtures and copolymers of any of the foregoing. The biodegradable polymer may also be a surface erodable polymer such as polyhydroxybutyrate and its copolymers, polycaprolactone, polyanhydrides (both crystalline and amorphous), maleic anhydride copolymers, and zinc-calcium phosphate.

Such coatings used with the present invention may be formed by any method known to one in the art. For example, an initial polymer/solvent mixture can be formed and then the therapeutic agent added to the polymer/solvent mixture.

Alternatively, the polymer, solvent, and therapeutic agent can be added simultaneously to form the mixture. The polymer/solvent/therapeutic agent mixture may be a dispersion, suspension or a solution. The therapeutic agent may also be mixed with the polymer in the absence of a solvent. The therapeutic agent may be dissolved in the polymer/solvent mixture or in the polymer to be in a true solution with the mixture or polymer, dispersed into fine or micronized particles in the mixture or polymer, suspended in the mixture or polymer based on its solubility profile, or combined with micelle-forming compounds such as surfactants or adsorbed onto small carrier particles to create a suspension in the mixture or polymer. The coating may comprise multiple polymers and/or multiple therapeutic agents.

The coating is typically from about 1 to about 50 microns thick. In the case of balloon catheters, the thickness is preferably from about 1 to about 10 microns, and more preferably from about 2 to about 5 microns. Very thin polymer coatings, such as about 0.2-0.3 microns and much thicker coatings, such as more than 10 microns, are also possible. It is also within the scope of the present invention to apply multiple layers of polymer coatings onto the medical device. Such multiple layers may contain the same or different therapeutic agents and/or the same or different polymers. Methods of choosing the type, thickness and other properties of the polymer and/or therapeutic agent to create different release kinetics are well known to one in the art.

The medical device may also contain a radio-opacifying agent within its structure to facilitate viewing the medical device during insertion and at any point while the device is implanted. Non-limiting examples of radio-opacifying agents are bismuth subcarbonate, bismuth oxychloride, bismuth trioxide, barium sulfate, tungsten, and mixtures thereof.

While the present invention has been described with reference to what are presently considered to be preferred embodiments thereof, it is to be understood that the present invention is not limited to the disclosed embodiments or constructions. On the contrary, the present invention is intended to cover various modifications and equivalent arrangements. For example, the coating material may comprise a flowable solid material, such as a powder, in lieu of a fluid, as long as the flowable solid coating material can be reliably fed through the dispensing device and accept a charge imparted by the second potential. The present invention is also suitable for use in a high speed automated medical device coating apparatus. In as much as this invention references dispensed particles, these particles can be in the form of droplets with or without entrained solids at various levels of evaporation. Furthermore, these particles can be dispensed as a solution, a suspension, an emulsion, or any type flowable material as described above.

While the various elements of the disclosed invention are described and/or shown in various combinations and configurations, which are exemplary, other combinations and configurations, including more, less or only a single embodiment, are also within the spirit and scope of the present invention.

We claim:

1. A method for spray application of coating material onto a medical device, comprising the steps of:

(a) using a micronozzle, wherein the micronozzle comprises at least one nozzle inlet and at least one nozzle orifice;

(b) introducing a coating material into the micronozzle, wherein the coating material is in fluid communication with the nozzle inlet and nozzle orifice, and wherein the coating material is retained in the micronozzle for a residence time of less than 0.01 seconds;

(c) ejecting the coating material form the nozzle orifice toward the medical device; and (d) atomizing the coating material.

2. The method of claim 1, wherein the micronozzle further comprises at least one passageway, wherein the passageway is in communication with the at least one nozzle inlet and the at least one nozzle orifice.

3. The method of claim 2, wherein the micronozzle is formed from a plurality of sheets, each sheet having at least one opening through the sheet, the plurality of sheets arranged to define the at least one passageway.

4. The method of claim 3, wherein the plurality of sheets are bonded together to form a laminated micronozzle having the at least one passageway.

5. The method of claim 3, wherein the plurality of sheets are bonded together to form a laminated micronozzle having at least one internal chamber.

6. The method of claim 3, wherein the opening is formed by an etching process.

7. The method of claim 6, wherein the etching process is a chemical etching process.

8. The method of claim 1, wherein the coating material contains a therapeutic agent.

9. The method of claim 8, wherein the therapeutic agent is selected from the group consisting of paclitaxel, sirolimus, zotarolimus, and everolimus.

10. The method of claim 1, wherein the medical device is a stent.

11. The method of claim 1, wherein the micronozzle is a swirl nozzle.

12. The method of claim 1, further comprising the step of coating a portion of a medical device.

13. The method of claim 1, further comprising the step of providing a plurality of micronozzles, wherein the micronozzles are arranged to coat the entire medical device.

14. The method of claim 1, wherein the coating material is atomized into non-charged droplets.

15. A method for spray application of coating material onto a medical device, comprising the steps of:

(a) using a coating discharge nozzle, wherein the discharge nozzle comprises a discharge nozzle orifice, a coating material micronozzle having a first passageway, and a gas-assist nozzle having a second passageway;

(b) flowing a coating material into the micronozzle through the first passageway towards the discharge nozzle orifice, wherein the coating material is retained in the micronozzle for a residence time of less than 0.01 seconds;

(c) flowing a pressurized atomizing gas into the gas-assist nozzle through the second passageway towards the discharge nozzle orifice;

(d) entraining a portion of the coating material within the atomizing gas ejected from the discharge nozzle, wherein the coating material is atomized; and (e) spraying the atomized coating material towards a portion of the medical device.

16. The method of claim 15, wherein the coating material micronozzle further comprises a coating material nozzle orifice in fluid communication with the first passageway, and the gas-assist nozzle further comprises a gas-assist nozzle orifice in fluid communication with the second passageway, and the coating material nozzle orifice is positioned concentric with the gas-assist nozzle orifice, with the gas-assist nozzle orifice having a larger diameter than the coating material nozzle orifice.

17. The method of claim 15, wherein the medical device is a stent.

18. The method of claim 15, wherein the coating material contains a therapeutic agent.

19. The method of claim 15, wherein the micronozzle is a swirl nozzle.

20. The method of claim 15, wherein the coating material is atomized into non-charged droplets.

* * * * *

UNITED STATES PATENT AND TRADEMARK OFFICE

CERTIFICATE OF CORRECTION

PATENT NO. : 7,758,908 B2
APPLICATION NO. : 11/390179
DATED : July 20, 2010
INVENTOR(S) : Pham et al.

It is certified that error appears in the above-identified patent and that said Letters Patent is hereby corrected as shown below:

Claim 1, line 11 (column 10, line 1), "material form" should be changed to --material from--.

Signed and Sealed this
Eighteenth Day of January, 2011

David J. Kappos

David J. Kappos
*Director of the United States Patent and Trademark Office*